US010830489B2

(12) United States Patent
Kilgo et al.

(10) Patent No.: US 10,830,489 B2
(45) Date of Patent: Nov. 10, 2020

(54) WET OR DRY CONDENSATE TRAPS FOR HEATING AND COOLING

(71) Applicant: Trane International Inc., Davidson, NC (US)

(72) Inventors: Richard Kilgo, Whitehouse, TX (US); Shiva kumar Kolloju, Nalgonda (IN); Ragunanthanan Mylsamy, Chennai (IN)

(73) Assignee: TRANE INTERNATIONAL INC., Davidson, NC (US)

( * ) Notice: Subject to any disclaimer, the term of this patent is extended or adjusted under 35 U.S.C. 154(b) by 188 days.

(21) Appl. No.: 15/883,891

(22) Filed: Jan. 30, 2018

(65) Prior Publication Data

US 2019/0234651 A1 Aug. 1, 2019

(51) Int. Cl.
*F24F 13/22* (2006.01)

(52) U.S. Cl.
CPC ..... *F24F 13/222* (2013.01); *F24F 2013/227* (2013.01)

(58) Field of Classification Search
CPC .... F24F 13/222; F24F 2013/227; F24F 13/22; F25D 21/14; F25D 2321/146; F25D 17/047; F16T 1/22; F16T 1/45; Y01T 137/4501; Y01T 137/4613
See application file for complete search history.

(56) References Cited

U.S. PATENT DOCUMENTS

| | | | | |
|---|---|---|---|---|
| 139,739 | A * | 6/1873 | Tracy | E03C 1/288 137/247.21 |
| 431,384 | A * | 7/1890 | Mundy | E03C 1/288 137/247.21 |
| 6,877,333 | B1 * | 4/2005 | Cantolino | F24F 13/222 210/300 |
| 6,931,882 | B1 * | 8/2005 | Yang | F16T 1/22 62/285 |
| 7,191,606 | B1 * | 3/2007 | Dwyer | F24F 13/222 62/150 |
| 7,854,238 | B2 | 12/2010 | Zatarain | |
| 9,776,474 | B2 * | 10/2017 | Kume | F24F 13/222 |
| 2003/0037561 | A1 * | 2/2003 | Chaves | F24F 13/222 62/285 |
| 2005/0198989 | A1 * | 9/2005 | Cantalino | C02F 1/688 62/303 |
| 2006/0096639 | A1 * | 5/2006 | Coogle | F16L 55/07 137/268 |

(Continued)

*Primary Examiner* — Cassey D Bauer
(74) *Attorney, Agent, or Firm* — Womble Bond Dickinson (US) LLP

(57) ABSTRACT

A condensate trap for an air handling unit is provided. The condensate trap includes at least one channel configured to selectively receive condensation flowing from the air handling unit, a drain outlet configured to selectively discharge condensation from the at least one channel, and a sealing device configured to float above condensation flowing from the least one channel to the drain outlet. The sealing device is further configured to sit atop a bottom surface of the at least one channel such that a seal is created when the at least one channel does not contain condensation, and to prevent a flow of contaminated air from the drain outlet to the air handler without completely blocking airflow from the sealing device to the air handler.

14 Claims, 6 Drawing Sheets

(56) References Cited

U.S. PATENT DOCUMENTS

| | | | | |
|---|---|---|---|---|
| 2008/0099083 | A1* | 5/2008 | Nishimoto | E03C 1/294 137/533 |
| 2008/0216503 | A1* | 9/2008 | Cantolino | F25D 21/14 62/285 |
| 2009/0056346 | A1* | 3/2009 | Zatarain | F25D 21/14 62/55.5 |
| 2014/0130529 | A1* | 5/2014 | Kaiser | B08B 9/032 62/150 |
| 2017/0299078 | A1* | 10/2017 | Stammer | F24F 13/222 |
| 2019/0071331 | A1* | 3/2019 | Italia | F24F 13/00 |

* cited by examiner

WET OR DRY CONDENSATE TRAPS FOR HEATING AND COOLING

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems may generally be used in residential and/or commercial areas for heating and/or cooling to create comfortable temperatures inside those areas. Some HVAC systems may be split-type heat pump systems that have an indoor and outdoor unit and are capable of cooling a comfort zone by operating in a cooling mode for transferring heat from a comfort zone to an ambient zone using a refrigeration cycle and also generally capable of reversing the direction of refrigerant flow through the components of the HVAC system so that heat is transferred from the ambient zone to the comfort zone, thereby heating the comfort zone. Such split-type heat pump systems commonly use an inclined heat exchanger as the indoor heat exchanger due to characteristics such as efficient performance, compact size, and cost effectiveness.

SUMMARY

In some embodiments of the disclosure, a condensate trap for an air handling unit is provided. The condensate trap includes at least one channel configured to selectively receive condensation flowing from the air handling unit, a drain outlet configured to selectively discharge condensation from the at least one channel, and a sealing device configured to float above condensation flowing from the least one channel to the drain outlet. The sealing device is further configured to sit atop a bottom surface of the at least one channel such that a seal is created when the at least one channel does not contain condensation, and to prevent a flow of contaminated air from the drain outlet to the air handler without completely blocking airflow from the sealing device to the air handler.

In other embodiments of the disclosure, a condensate trap for a condensing furnace is provided. The condensate trap includes an intake pipe configured to selectively receive ambient air, where the intake pipe is coupled to an air moving device configured to draw air from the intake pipe. The condensate trap further comprises a primary channel configured to receive condensation formed as ambient air is drawn into the intake pipe during operation of the condensing furnace. The primary channel is disposed between the intake pipe and the air moving device such that the condensate trap prevents condensation from entering the air moving device.

For the purpose of clarity, any one of the embodiments disclosed herein may be combined with any one or more other embodiments disclosed herein to create a new embodiment within the scope of the present disclosure.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

It should be understood at the outset that although illustrative implementations of one or more embodiments of the present disclosure are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

In an HVAC system including equipment configured to cool and/or heat air such as air handlers and furnaces, a drain pan may be used to collect and remove condensed water formed on an evaporator coil in a heat exchanger during operation of the HVAC system. Condensed water from the drain pan then may be drained through a condensate trap such as S- or U-shaped traps, which use the condensation within the trap to prevent air backflow from the trap into HVAC equipment. While such traps typically function as intended, issues may arise in some cases. For example, when an air handler has been off for an extended duration or operating in heating mode, water within a trap may evaporate. Consequently, the air handler may draw in air from the trap, which may contain contaminates such as sewage gasses. Moreover, air drawn into the air handler unit may prevent condensate from draining properly, thereby causing an increase of condensate buildup within the drain pain. Issues may also arise when a furnace is operating in cooling mode, where condensation may form outside the furnace due to the ambient air and low pressure at an air vent through which fresh air is drawn. In turn, the furnace may inadvertently draw in condensed water, which may contact and potentially damage equipment such as an inducer of the furnace. Accordingly, embodiments of the present disclosure provide drain traps configured to mitigate and prevent issues that might otherwise arise when operating HVAC equipment in heating and cooling modes.

Figure 1:
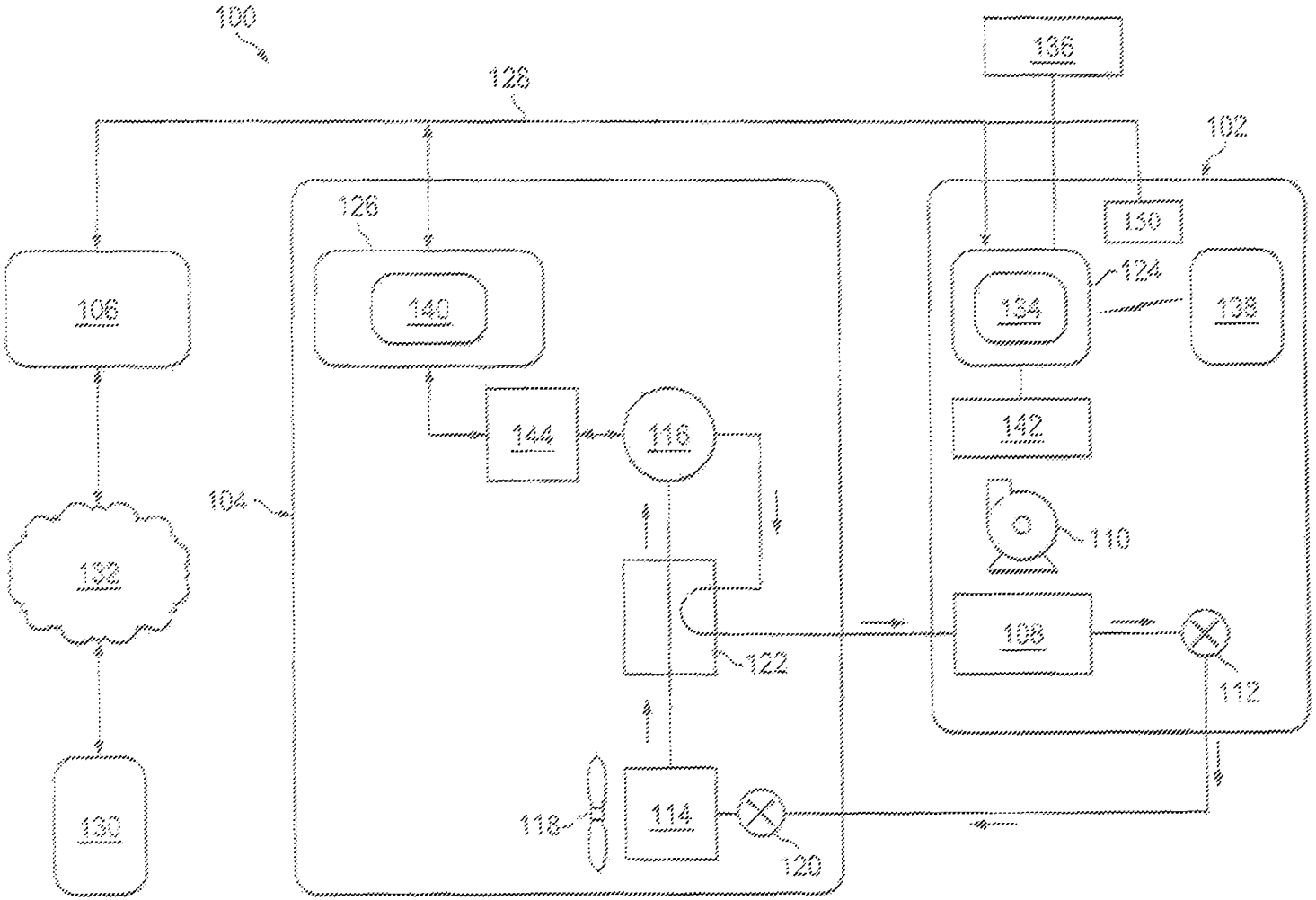
FIG. 1 is a schematic diagram of an HVAC system according to an embodiment of the disclosure.

Referring now to FIG. 1, a schematic diagram of an HVAC system 100 is shown according to an embodiment of the disclosure. Most generally, HVAC system 100 comprises a heat pump system that may be selectively operated to implement one or more substantially closed thermodynamic refrigeration cycles to provide a cooling functionality (hereinafter "cooling mode") and/or a heating functionality (hereinafter "heating mode"). The HVAC system 100, configured as a heat pump system, generally comprises an indoor unit 102, an outdoor unit 104, and a system controller 106 that may generally control operation of the indoor unit 102 and/or the outdoor unit 104.

Indoor unit 102 generally comprises an indoor air handling unit comprising an indoor heat exchanger 108, an indoor fan 110, an indoor metering device 112, and an indoor controller 124. The indoor heat exchanger 108 may generally be configured to promote heat exchange between refrigerant carried within internal tubing of the indoor heat exchanger 108 and an airflow that may contact the indoor heat exchanger 108 but that is segregated from the refrigerant. In some embodiments, the indoor heat exchanger 108 may comprise a plate-fin heat exchanger. However, in other embodiments, indoor heat exchanger 108 may comprise a microchannel heat exchanger and/or any other suitable type of heat exchanger.

The indoor fan 110 may generally comprise a centrifugal blower comprising a blower housing, a blower impeller at least partially disposed within the blower housing, and a blower motor configured to selectively rotate the blower impeller. The indoor fan 110 may generally be configured to provide airflow through the indoor unit 102 and/or the indoor heat exchanger 108 to promote heat transfer between the airflow and a refrigerant flowing through the indoor heat exchanger 108. The indoor fan 110 may also be configured to deliver temperature-conditioned air from the indoor unit 102 to one or more areas and/or zones of a climate controlled structure. The indoor fan 110 may generally comprise a mixed-flow fan and/or any other suitable type of fan. The indoor fan 110 may generally be configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, however, the indoor fan 110 may be a single speed fan.

The indoor metering device 112 may generally comprise an electronically-controlled motor-driven electronic expansion valve (EEV). In some embodiments, however, the indoor metering device 112 may comprise a thermostatic expansion valve, a capillary tube assembly, and/or any other suitable metering device. In some embodiments, while the indoor metering device 112 may be configured to meter the volume and/or flow rate of refrigerant through the indoor metering device 112, the indoor metering device 112 may also comprise and/or be associated with a refrigerant check valve and/or refrigerant bypass configuration when the direction of refrigerant flow through the indoor metering device 112 is such that the indoor metering device 112 is not intended to meter or otherwise substantially restrict flow of the refrigerant through the indoor metering device 112.

Outdoor unit 104 generally comprises an outdoor heat exchanger 114, a compressor 116, an outdoor fan 118, an outdoor metering device 120, a reversing valve 122, and an outdoor controller 126. In some embodiments, the outdoor unit 104 may also comprise a plurality of temperature sensors for measuring the temperature of the outdoor heat exchanger 114, the compressor 116, and/or the outdoor ambient temperature. The outdoor heat exchanger 114 may generally be configured to promote heat transfer between a refrigerant carried within internal passages of the outdoor heat exchanger 114 and an airflow that contacts the outdoor heat exchanger 114 but that is segregated from the refrigerant. In some embodiments, outdoor heat exchanger 114 may comprise a plate-fin heat exchanger. However, in other embodiments, outdoor heat exchanger 114 may comprise a spine-fin heat exchanger, a microchannel heat exchanger, or any other suitable type of heat exchanger.

The compressor 116 may generally comprise a variable speed scroll-type compressor that may generally be configured to selectively pump refrigerant at a plurality of mass flow rates through the indoor unit 102, the outdoor unit 104, and/or between the indoor unit 102 and the outdoor unit 104. In some embodiments, the compressor 116 may comprise a rotary type compressor configured to selectively pump refrigerant at a plurality of mass flow rates. In alternative embodiments, however, the compressor 116 may comprise a modulating compressor that is capable of operation over a plurality of speed ranges, a reciprocating-type compressor, a single speed compressor, and/or any other suitable refrigerant compressor and/or refrigerant pump. In some embodiments, the compressor 116 may be controlled by a compressor drive controller 144, also referred to as a compressor drive and/or a compressor drive system.

The outdoor fan 118 may generally comprise an axial fan comprising a fan blade assembly and fan motor configured to selectively rotate the fan blade assembly. The outdoor fan 118 may generally be configured to provide airflow through the outdoor unit 104 and/or the outdoor heat exchanger 114 to promote heat transfer between the airflow and a refrigerant flowing through the indoor heat exchanger 108. The outdoor fan 118 may generally be configured as a modulating and/or variable speed fan capable of being operated at a plurality of speeds over a plurality of speed ranges. In other embodiments, the outdoor fan 118 may comprise a mixed-flow fan, a centrifugal blower, and/or any other suitable type of fan and/or blower, such as a multiple speed fan capable of being operated at a plurality of operating speeds by selectively electrically powering different multiple electromagnetic windings of a motor of the outdoor fan 118. In yet other embodiments, the outdoor fan 118 may be a single speed fan. Further, in other embodiments, however, the outdoor fan 118 may comprise a mixed-flow fan, a centrifugal blower, and/or any other suitable type of fan and/or blower.

The outdoor metering device 120 may generally comprise a thermostatic expansion valve. In some embodiments, however, the outdoor metering device 120 may comprise an electronically-controlled motor driven EEV similar to indoor metering device 112, a capillary tube assembly, and/or any other suitable metering device. In some embodiments, while the outdoor metering device 120 may be configured to meter the volume and/or flow rate of refrigerant through the outdoor metering device 120, the outdoor metering device 120 may also comprise and/or be associated with a refrigerant check valve and/or refrigerant bypass configuration when the direction of refrigerant flow through the outdoor metering device 120 is such that the outdoor metering device 120 is not intended to meter or otherwise substantially restrict flow of the refrigerant through the outdoor metering device 120.

The reversing valve 122 may generally comprise a four-way reversing valve. The reversing valve 122 may also comprise an electrical solenoid, relay, and/or other device configured to selectively move a component of the reversing valve 122 between operational positions to alter the flow path of refrigerant through the reversing valve 122 and consequently the HVAC system 100. Additionally, the reversing valve 122 may also be selectively controlled by the system controller 106 and/or an outdoor controller 126.

The system controller 106 may generally be configured to selectively communicate with an indoor controller 124 of the indoor unit 102, an outdoor controller 126 of the outdoor unit 104, and/or other components of the HVAC system 100. In some embodiments, the system controller 106 may be configured to control operation of the indoor unit 102 and/or the outdoor unit 104. In some embodiments, the system controller 106 may be configured to monitor and/or communicate with a plurality of temperature sensors associated with components of the indoor unit 102, the outdoor unit 104, and/or the ambient outdoor temperature. Additionally, in some embodiments, the system controller 106 may comprise a temperature sensor and/or may further be configured to control heating and/or cooling of zones associated with the HVAC system 100. In other embodiments, however, the system controller 106 may be configured as a thermostat for controlling the supply of conditioned air to zones associated with the HVAC system 100.

The system controller 106 may also generally comprise an input/output (I/O) unit (e.g., a graphical user interface, a touchscreen interface, or the like) for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially and/or unrelated to operation of the HVAC system 100. In some embodiments, however, the system controller 106 may not comprise a display and may derive all information from inputs from remote sensors and remote configuration tools.

In some embodiments, the system controller 106 may be configured for selective bidirectional communication over a communication bus 128. In some embodiments, portions of the communication bus 128 may comprise a three-wire connection suitable for communicating messages between the system controller 106 and one or more of the HVAC system 100 components configured for interfacing with the communication bus 128. Still further, the system controller 106 may be configured to selectively communicate with HVAC system 100 components and/or any other device 130 via a communication network 132. In some embodiments, the communication network 132 may comprise a telephone network, and the other device 130 may comprise a telephone. In some embodiments, the communication network 132 may comprise the Internet, and the other device 130 may comprise a smartphone and/or other Internet-enabled mobile telecommunication device. In other embodiments, the communication network 132 may also comprise a remote server.

The indoor controller 124 may be carried by the indoor unit 102 and may generally be configured to receive information inputs, transmit information outputs, and/or otherwise communicate with the system controller 106, the outdoor controller 126, and/or any other device 130 via the communication bus 128 and/or any other suitable medium of communication. In some embodiments, the indoor controller 124 may be configured to communicate with an indoor personality module 134 that may comprise information related to the identification and/or operation of the indoor unit 102. In some embodiments, the indoor controller 124 may be configured to receive information related to a speed of the indoor fan 110, transmit a control output to an electric heat relay, transmit information regarding an indoor fan 110 volumetric flow-rate, communicate with and/or otherwise affect control over an air cleaner 136, and communicate with an indoor EEV controller 138. In some embodiments, the indoor controller 124 may be configured to communicate with an indoor fan controller 142 and/or otherwise affect control over operation of the indoor fan 110. In some embodiments, the indoor personality module 134 may comprise information related to the identification and/or operation of the indoor unit 102 and/or a position of the outdoor metering device 120.

The indoor EEV controller 138 may be configured to receive information regarding temperatures and/or pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112. The indoor EEV controller 138 may also be configured to communicate with the outdoor metering device 120 and/or otherwise affect control over the outdoor metering device 120.

The outdoor controller 126 may be carried by the outdoor unit 104 and may be configured to receive information inputs, transmit information outputs, and/or otherwise communicate with the system controller 106, the indoor controller 124, and/or any other device 130 via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the compressor 116, the outdoor fan 118, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with and/or control a compressor drive controller 144 that is configured to electrically power and/or control the compressor 116.

In some embodiments, the HVAC 100 system may comprise a heat source such as a furnace, which may be configured to burn fuel such as natural gas, heating oil, propane, coal, and/or any suitable material capable of generating heat or power. In such embodiments, the furnace 150 may comprise an inducer blower (e.g., similar to the indoor fan 110) configured to circulate air-fuel mixture through the furnace 150.

In some aspects, the HVAC system 100 may be configured to operate in a so-called heating mode in which heat may generally be absorbed by refrigerant at the outdoor heat exchanger 114 and rejected from the refrigerant at the indoor heat exchanger 108. Starting at the compressor 116, the compressor 116 may be operated to compress refrigerant and pump the relatively high temperature and high pressure compressed refrigerant through the reversing valve 122 and to the indoor heat exchanger 108, where the refrigerant may transfer heat to an airflow that is passed through and/or into contact with the indoor heat exchanger 108 by the indoor fan 110. After exiting the indoor heat exchanger 108, the refrigerant may flow through and/or bypass the indoor metering device 112, such that refrigerant flow is not substantially restricted by the indoor metering device 112. Refrigerant generally exits the indoor metering device 112 and flows to the outdoor metering device 120, which may meter the flow of refrigerant through the outdoor metering device 120, such that the refrigerant downstream of the outdoor metering device 120 is at a lower pressure than the refrigerant upstream of the outdoor metering device 120. From the outdoor metering device 120, the refrigerant may enter the outdoor heat exchanger 114. As the refrigerant is passed through the outdoor heat exchanger 114, heat may be transferred to the refrigerant from an airflow that is passed through and/or into contact with the outdoor heat exchanger 114 by the outdoor fan 118. Refrigerant leaving the outdoor heat exchanger 114 may flow to the reversing valve 122, where the reversing valve 122 may be selectively configured to divert the refrigerant back to the compressor 116, where the refrigeration cycle may begin again.

In some aspects, the HVAC system 100 may be configured to operate in a so-called cooling mode, in which case the roles of the indoor heat exchanger 108 and the outdoor heat exchanger 114 may generally be reversed as compared to their operation in the above-described heating mode. For example, the reversing valve 122 may be controlled to alter the flow path of the refrigerant from the compressor 116 to the outdoor heat exchanger 114 first and then to the indoor heat exchanger 108, the indoor metering device 112 may be enabled, and the outdoor metering device 120 may be disabled and/or bypassed. In cooling mode, heat may generally be absorbed by refrigerant at the indoor heat exchanger 108 and rejected by the refrigerant at the outdoor heat exchanger 114. As the refrigerant is passed through the indoor heat exchanger 108, the indoor fan 110 may be operated to move air into contact with the indoor heat exchanger 108, thereby transferring heat to the refrigerant from the air surrounding the indoor heat exchanger 108. Additionally, as refrigerant is passed through the outdoor heat exchanger 114, the outdoor fan 118 may be operated to move air into contact with the outdoor heat exchanger 114, thereby transferring heat from the refrigerant to the air surrounding the outdoor heat exchanger 114.

Figure 2:
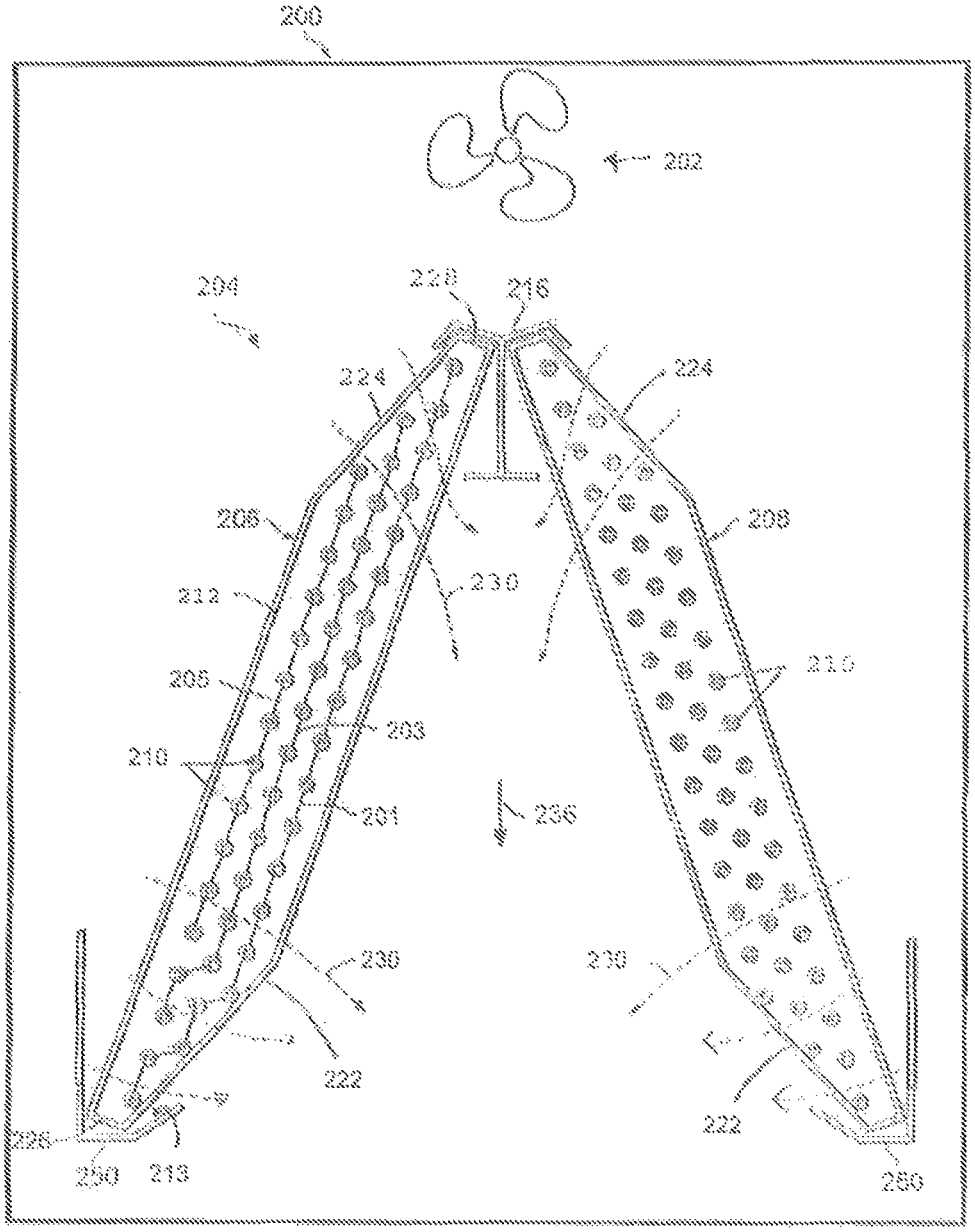
FIG. 2 is a schematic diagram of an air handling unit according to an embodiment of the disclosure.

Referring now to FIG. 2, a schematic diagram of an air handling unit 200 is shown according to an embodiment of the disclosure. The air handling unit 200 may generally be configured as the indoor unit 102 or the outdoor unit 104 of FIG. 1. In addition, the air handling unit 200 may include a blower assembly 202 that is substantially similar to the indoor fan 110 or the outdoor fan 118 of FIG. 1. According to some aspects, the blower assembly 202 may be selectively removable from the air handling unit 200. The blower assembly 202 may generally comprise an electrically powered, motor driven rotatable blower that may be configured to deliver airflow 230 through the air handling unit 200 in a downstream direction 236. In other aspects, the blower assembly 202 may be configured and/or repositioned to deliver airflow in an upstream direction.

The air handling unit 200 may include a heat exchanger assembly 204 disposed downstream from the blower assembly 202. In other implementations, the heat exchanger assembly 204 may be disposed above the blower assembly 202, which may supply similar airflow by drawing air in the downstream direction 236. The heat exchanger assembly 204 may generally be configured as and/or employed as the indoor heat exchanger 108 or the outdoor heat exchanger 114 of FIG. 1. The heat exchanger assembly 204 may be disposed within a fluid duct of the air handling unit 200 and may also be selectively removable from the air handling unit 200.

In the implementation depicted in FIG. 2, the heat exchanger assembly 204 comprises a first slab 206 and a second slab 208 arranged to define an "A-coil" or "A-frame" heat exchanger assembly 204. However, it is to be understood that the first and second slabs 206, 208 may be arranged to define any suitable type of heat exchanger such as, but not limited to, a W-coil ("W-frame"), M-coil ("M-frame"), N-coil ("N-frame"), inverted N-Coil ("inverted N-frame"), V-coil ("V-frame"), etc. It is also to be understood that the heat exchanger assembly 204 may comprise more or less slabs in other implementations.

The first and second slabs 206, 208 generally comprise a plurality of tubes 210 arranged in one or more rows and disposed longitudinally through a plurality of adjacently disposed fins 212. The plurality of longitudinally finned tubes 210 and/or fins 212 are generally configured to carry a refrigerant, gas, liquid, and/or other suitable heat transfer medium configured to exchange heat with an airflow 230 passing between adjacent tubes 210 and/or adjacent fins 212. The tubes 210 and/or the fins 212 may generally be constructed of copper, stainless steel, aluminum, and/or another suitable material suitable for promoting heat transfer between the heat exchange medium carried within the tubes 210 and the airflow 230.

In some embodiments, one or more tubes 210 may extend through and beyond a fin 212 located at each end of the heat exchanger assembly 204 and be joined in fluid communication with one or more tubes 210. For example, the tubes 210 may be joined by a hairpin joint and/or U-joint to form a fluid circuit through the heat exchanger assembly 204. In other embodiments, the tubes 210 may be arranged in a plurality of parallel flow-paths and connected at each end of the heat exchanger assembly 204 by one or more headers to form a fluid circuit through the heat exchanger assembly 204.

The plurality of longitudinally finned tubes 210 may generally be arranged in rows such as a first row 201 of tubes 210, second row 203 of tubes 210, and a third row 205 of tubes 210. In some aspects, the tubes 210 may be arranged such that a first row 201 of tubes 210 directly receives the airflow 230 coming from the downstream direction 236 without first contacting another tube 210 not in that first row 201 of tubes 210. As such, an adjacent second row 203 of tubes 210 may receive the airflow 230 after passing between and/or contacting adjacently located tubes 210 in the first row 201, while a third row 205 of tubes 210 may receive the airflow 230 after passing between and/or contacting adjacently located tubes 210 in the second row 203.

In other aspects, the tubes 210 may be arranged such that the third row 205 of tubes 210 directly receives the airflow 230 coming from the downstream direction 236 without first contacting another tube 210 not in that third row 201 of tubes 210. As such, an adjacent second row 203 of tubes 210 may receive the airflow 230 after passing between and/or contacting adjacently located tubes 210 in the third row 205, while the first row 201 of tubes 210 may receive the airflow 230 after passing between and/or contacting adjacently located tubes 210 in the second row 203. Additionally, while the heat exchanger assembly 204 is depicted as comprising three rows, in some embodiments, the heat exchanger assembly 204 may comprise as few as one row or any number of additional rows as a result of the size and/or other design criteria of the heat exchanger assembly 204.

In some embodiments, the air handling unit 200 may comprise at least one drain pan 250 disposed at a lower end 226 of the heat exchanger assembly 204. The air handling unit 200 may also comprise at least one baffle 216 disposed at an upper end 228 of the heat exchanger assembly 204. The lower end 226 of the heat exchanger assembly 204 may include a first tapered end 222, while the upper end 228 may include a second tapered end 224. In other implementations, however, the first end 222 and/or the second end 224 of the heat exchanger assembly 204 may not be tapered.

As shown in FIG. 2, each drain pan 250 is disposed substantially below the heat exchanger assembly 204 so that as condensation forms on and drips from the first and second slabs 206 and 208, the airflow 230 directs condensation into the drain pan 250. Each drain pan 250 may generally extend along the first tapered end 222 and form a concavity 213 in the lower portion of the drain pan 250 that extends around the lower end 226 and vertically along an axis that is substantially orthogonal to the lower end 226. The concavity 213 may generally be configured to catch and/or receive condensate that may form on the tubes 210 and/or the fins 212 (e.g., as water vapor condenses when the air handling unit 200 generates a supply of cool air). In some embodiments, the drain pan 250 may comprise a channel, tube, and/or plurality of tubes for carrying away condensate from the concavity 213 of the drain pan 250. Additionally, the air handling unit 200 may comprise one or more drain pipes (not shown) configured to drain condensate from the concavity 213 in the drain pan 250.

Figure 3:
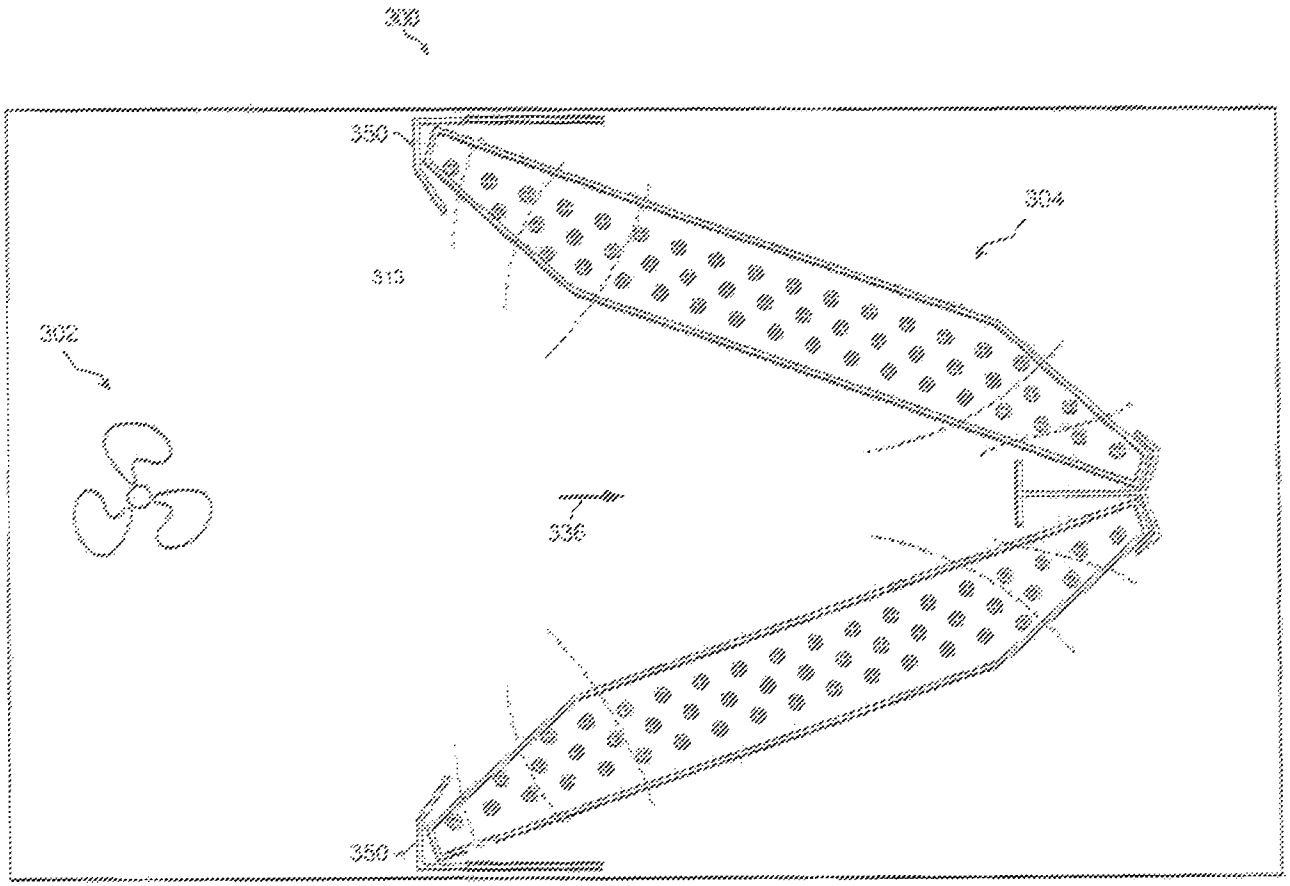
FIG. 3 is a schematic diagram of an air handling unit according to another embodiment of the disclosure.

Referring now to FIG. 3, a schematic diagram of an air handling unit 300 is shown according to another embodiment of the disclosure. The air handling unit 300 may generally be similar to the air handling unit 200 of FIG. 2, except the fan assembly 302 and the heat exchanger assembly 304 in FIG. 3 are configured according to a horizontal application such that air primarily flows through the heat exchanger assembly 304 in a horizontal direction 336. In addition, the air handling unit 300 may include at least one drain pan 350 different than the at least one drain pan 250 of FIG. 2. Other than the foregoing distinctions, the air handling unit 300 may comprise substantially similar components as the air handling unit 200 of FIG. 2. Accordingly, the prior discussion of such components is similarly applicable and not repeated here for brevity. Further, while two drain pans 350 are depicted in FIG. 3, it is to be understood that the air handling unit 300 may include more or less drain pans 350 in other implementations. It is also to be understood that the air handling unit 300 may include one or more drain pipes (not shown) configured to drain condensate from a concavity 313 formed in the drain pan 350.

Figure 4:
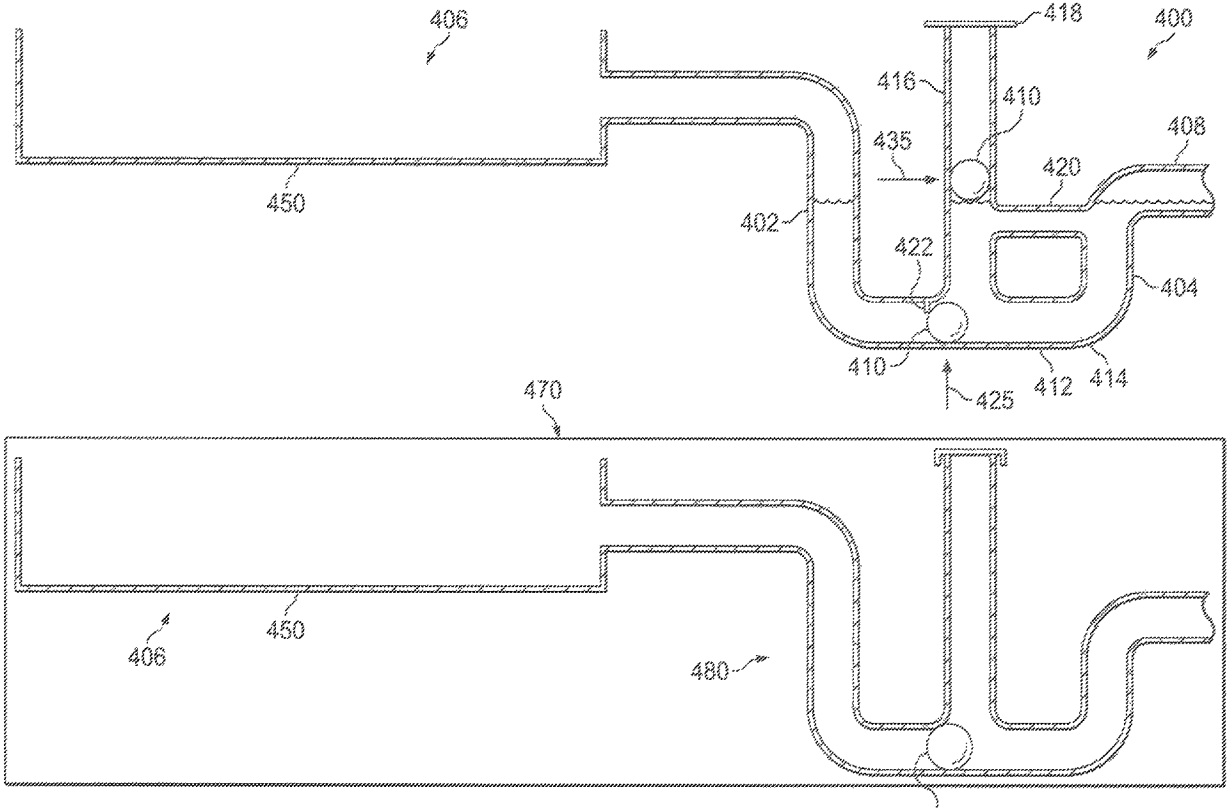
FIGS. 4-6 depict examples of condensate traps according to embodiments of the disclosure.

FIG. 4 depicts an example of a condensate trap 400 according to an embodiment of the disclosure. While the condensate trap 400 is depicted as a U-shaped trap in this example, the condensate trap 400 may comprise any suitable type of trap in other examples (e.g., P-shaped or S-shaped). The condensate trap 400 comprises at least a first channel 402 and a second channel 404. The first channel 402 is configured to receive condensate from a drain pain 450 of an air handler 406. For example, the first channel 402 and drain pain 450 may generally be arranged such that condensation may flow away from the drain pan 450 and into the first channel 402 through the force of gravity.

In some aspects, the drain pan 450 may be substantially similar to the drain pans 250, 350 depicted in FIGS. 2 and 3, while the air handler 406 may be substantially similar to the air handling units 200, 300 depicted in FIGS. 2 and 3. In other aspects, however, the drain pan 450 and/or air handler 406 may comprise any suitable type of drain pan and/or air handler, respectively.

The second channel 404 is configured to fluidly connect to a drain outlet 408, through which condensate may be selectively displaced from the condensate trap 400. In some implementations, the drain outlet 408 may fluidly connect to an external site, e.g., a sewer system (not shown) such that waste, sewage gasses, or other matter may be transferred to the sewer system via the drain outlet 408.

The condensate trap 400 further comprises a sealing device such as a check ball 410. While FIG. 4 depicts an example of the condensation trap 400 containing a volume of condensate, it is to be understood that the check ball 410 is configured to sit atop a bottom surface 412 of a lower channel 414 when there is no condensation within the condensate trap 400 (as indicated by arrow 425). The check ball 410 may comprise any suitable material such that when condensation flows into the condensate trap 400, the check ball 410 is able to rise through a central channel 416 and float above the condensation (as indicated by arrow 435). In some embodiments, the condensate trap 400 may include a cap or cover 418, which may be removable to facilitate cleansing the condensate trap 400 and parts thereof. In addition, the condensate trap 400 may include a secondary channel 420 through which condensate may be selectively transferred from the condensate trap 400 and through the drain outlet 408.

In some implementations, the condensate trap 400 may be vented to prevent or minimize the possibility of air pressure pockets developing within the condensate trap 400. For example, the cover 418 may include an upper vent (not shown) to allow air to escape the condensate trap 400 (e.g., to the atmosphere). Moreover, the secondary channel 420 may include a vent (not shown) to facilitate the rise of condensation such that the check ball 410 floats upward, and thus is removed from the flow path of condensation (as indicated by arrow 435).

The air handler 406 may be configured to operate in the cooling and heating modes as previously described with respect to FIG. 1. During heating mode operation, the air handler 406 may draw in air from the condensate trap 400. Absent condensation, the check ball 410 sitting at the bottom surface 412 may be drawn toward the first channel 402 such as indicated by arrow 425. Block 470 depicts an example based on the check ball 410 being employed in a conventional trap 480 under similar circumstances. In this example, the physical interaction between the check ball 410 and inner walls of the conventional trap 480 may create a seal blocking airflow, thus preventing air from being drawn into the air handler 406. This seal may then prevent the air handler 406 from drawing potentially harmful matter such as sewage gasses.

During cooling mode operation, condensation generated by the air handler 406 may flow from the drain pan 450 and into the condensate trap 400 via the first channel 402. In some embodiments, the condensate trap 400 may be vented (e.g., via cover 418, secondary channel 420, etc.) to facilitate the rise of incoming condensation, while allowing the check ball 410 to float upward via central channel 416 so as not to obstruct the flow path of condensation to be discharged via the drain outlet 408. The condensate trap 400 is configured such that when condensation stops flowing into the condensate trap 400, the standing condensation within the condensate trap 400 acts to prevent a backflow of air from the drain outlet 408 to the air handler 406.

However, condensation within the condensate trap 400 may eventually evaporate during heating mode operation or if the air handler 406 is powered off for a prolonged period. Alternatively, the air handler 406 may be a newly installed unit. Because the condensate trap 400 may not contain condensate in such cases, the condensate trap 400 may not function properly, if at all.

As an example, a lack of condensation within the condensate trap 400 may cause the air handler 406 to draw in potentially contaminated air and/or gasses (e.g., via drain outlet 408) and expel such contaminates into conditioned space. In addition, the inrush of air into the air handler 406 may hinder or prevent condensation from draining into the condensate trap 400 via the first channel 402, thereby causing an increase of condensate buildup within the drain pan 450.

As another example, if the air handler 406 is new and initially operates in cooling mode under relatively dry and/or warm conditions, the lack of condensation may cause the air handler 406 to draw in air from the condensate trap 400. Consequently, the air being drawn into the air handler 406 may hinder or prevent condensation in the drain pan 450 from flowing into the condensate trap 400 via the first channel 402 until the air handler 406 is powered off.

In both examples, an event known as "water blow-off" may occur if condensation within the drain pan 450 cannot properly drain through the condensation trap 400. That is, the air handler 406 may inadvertently blow condensed water from the drain pan 450 into the airstream, where water may accumulate and potentially cause damage. For instance, condensed water may be swept into ductwork (not shown) and cause one or more ducts to harbor biological growth (e.g., mold, fungus, or algae), which may damage surrounding areas such as an attic, wall insulation, building structural elements, ceilings, carpets, personal belongings, etc.

Depending on the orientation of the air handler 406, condensed water may also protrude onto equipment. For instance, certain equipment may be particularly susceptible to water exposure in implementations where the air handler 406 is installed in a vertical position (e.g., FIG. 2) or horizontal position (e.g., FIG. 3). Water exposure may potentially damage equipment such as fan motors, especially those employing electronics such as variable speed motors and constant torque motors. Therefore, "water blow-off" can pose increased reliability concerns and/or costs (e.g., warranty expense).

As previously discussed with respect to block 470, a lack of condensate in a conventional trap 480 may result in the check ball 410 being drawn toward the first channel 402 such that a seal is created at the contact point between the check ball 410 and inner walls of the conventional trap 480. While the resulting seal may effectively prevent the air handler 406 from drawing in potential contaminates within the conventional trap 480, the lack of airflow created by the seal may prevent condensed water from flowing into the condensate trap 400 when operating the air handler 406.

In an embodiment, the condensate trap 400 may include one or more features to ensure that the check ball 410 does not completely block airflow when operating the air handler 406 in conditions where the condensate trap 400 is without water. To this end, the lower channel 414 of the condensate trap 400 may be configured with at least one protrusion 422 such that when the check ball 410 is located in a position such as indicated by arrow 425, at least some air is able to flow past the check ball 410 when in contact with the protrusion 422.

For instance, the protrusion 422 may be such that the check ball 410 interacts with the condensate trap 400 to create a seal configured to not only prevent the air handler 406 from drawing in contaminates within the condensate trap 400, but also prevent "water blow-off" from occurring by permitting a certain percentage of air to flow past the check ball 410 when operating the air handler 406 while the condensate trap 400 is empty. This way, condensation formed during operation of the air handler 406 may flow from the drain pan 450 into the first channel 402 even if the condensate trap 400 lacks water at runtime.

In general, ensuring that the check ball 410 and condensate trap 400 do not physically interact to create a complete seal may be accomplished using any suitable mechanism, i.e., in addition to and/or in place of the at least one protrusion 422. In some aspects, for example, the check ball 410 may be shaped and/or sized to prevent the check ball 410 from creating a complete seal with the inner walls of the condensate trap 400 when seated at the bottom surface 412 such as indicated by arrow 425. Further, while the check ball 410 is depicted as comprising a spherical configuration, the check ball 410 may comprise any suitable configuration, e.g., conical, triangular, rectangular, symmetrical, asymmetrical, etc.

In some embodiments, at least one protrusion 422 may be integrally formed as part of the condensate trap 400 itself. In other embodiments, at least one protrusion 422 may be added to one or more areas of the condensate trap 400 via any suitable mechanism, e.g., fasteners, injection molding, welding, etc. Further, it is to be understood that the protrusion 422 may comprise any suitable size, shape, and/or location, e.g., such that the check ball 410 may act as a one-way check valve that prevents contaminated air from flowing from the drain outlet 418 and into the air handler 406 when the protrusion contacts the check ball 410.

In summary, the condensate trap 400 may be configured such that when free of fluid (e.g., during heating mode operation or dry conditions), the check ball 410 prevents contaminated air from entering the air handler 406, but allows enough air to pass through so that condensation generated during operation of the air handler 406 may properly flow from the drain pain 450 and into the condensate trap 400. Accordingly, "water blow-off" and potential damage resulting therefrom may be avoided, as the condensate trap 400 disclosed herein may function properly regardless of whether or not condensation is present when operating the air handler 406 in heating mode or cooling mode.

Figure 5:
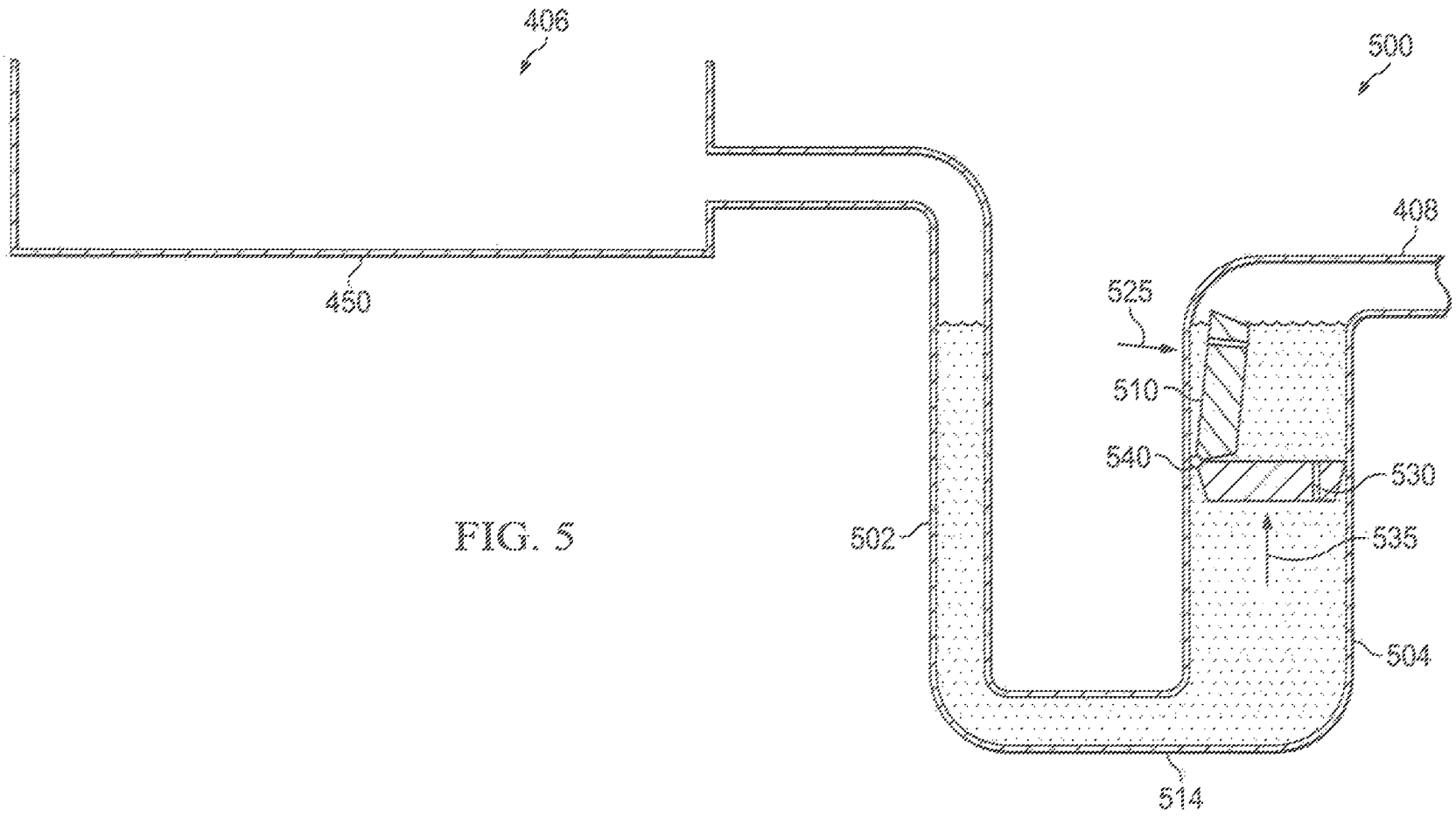

FIG. 5 depicts an example of a condensate trap 500 according to an embodiment of the disclosure. For convenience, elements common to FIGS. 4 and 5 are designated by like reference numerals. While the condensate trap 500 is depicted as a U-shaped trap in this example, the condensate trap 500 may comprise any suitable type of trap in other examples (e.g., P-shaped or S-shaped). The condensate trap 500 may comprise at least a first channel 502, second channel 504, and lower channel 514 substantially similar to the first channel 402, second channel 404, and lower channel 414, respectively. Generally speaking, the condensate trap 500 may function similar to the condensate trap 400 in that both are configured to prevent a backflow of air using condensation retained within the traps 400 and 500, except the condensate trap 500 employs a flapper valve 510 as a sealing device rather than a check ball 410.

During operation of the air handler 406, condensation generated by the air handler 406 may flow from the drain pan 450 and into the condensate trap 500 via the first channel 502. The flapper valve 510 is configured to float in an upward position such as indicated by arrow 525 when the level of condensation 500 rises past the flapper valve 510 and towards the drain outlet 408. The condensate trap 500 may comprise any suitable mechanism to facilitate movement of the flapper valve 510 such as one or more hinges 540. While the example in FIG. 5 depicts condensation as being at a level above the hinge 540, it is to be understood that when the level of condensation within the condensate trap 500 drops below the flapper valve 510, the flapper valve 510 may slide in a downward position such as indicated by arrow 535. Similar to a flapper valve commonly employed in toilets, the flapper valve 510 may create a watertight seal when moved to this latter position. Yet as previously discussed with respect to FIG. 4, the condensate trap 500 may not function properly if the seal created by the flapper valve 510 entirely blocks airflow.

In an embodiment, the condensate trap 500 may be configured to prevent the flapper valve 510 from creating a complete seal when seated in the downward position indicated by arrow 535. For example, the flapper valve 510 may comprise an elongated aperture 530 through which at least some air may flow past the flapper valve 510. This way, condensation formed during operation of the air handler 406 may flow from the drain pan 450 and into the first channel 502 when the condensation trap 500 is free of liquid.

It is to be understood that the aperture 530 may comprise different configurations in other implementations. In some implementations, the size and/or location of the aperture 530 may be configured to optimize airflow based upon the particular operating conditions in which the condensate trap 500 is employed. For example, the aperture 530 may be configured such that the flapper valve 510 prevents contaminated air/gasses within the condensate trap 500 from flowing into the air handler 406, but allows just enough air to pass through such that condensation may properly flow from the drain pain 450 and into the condensate trap 500.

Accordingly, condensate trap 500 may be used to avoid "water blow-off" and potential damage resulting therefrom for reasons similar to those discussed above with respect to condensate trap 400. However, the condensate trap 500 is configured such that condensation may be discharged via drain outlet 408 by flowing through flapper valve 510, whereas condensate trap 400 is configured such that condensation may be discharged via drain outlet 408 by flowing through a path free of check valve 410. Consequently, condensate trap 400 may be less prone to clogging than condensate trap 500, e.g., depending on the viscosity of the condensation to be drained.

Figure 6:
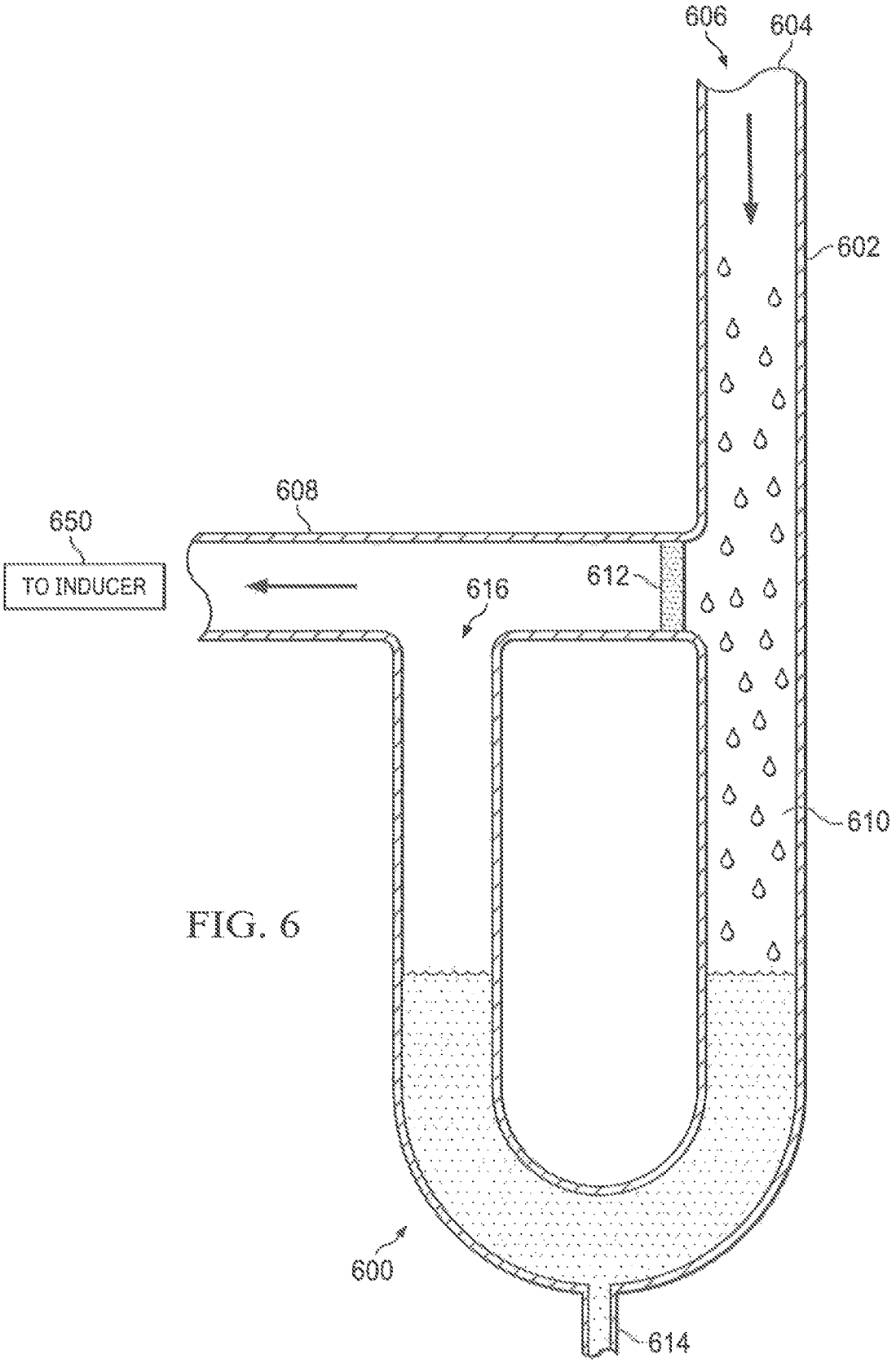

FIG. 6 depicts an embodiment of a condensate trap 600 according to an embodiment of the disclosure. While the condensate trap 600 is depicted as a P-shaped trap in this example, the condensate trap 600 may comprise any suitable type of trap in other examples (e.g., U-shaped or S-shaped). The condensate trap 600 may generally be employed in an indoor or outdoor unit of an HVAC system (e.g., system 100) such as discussed with respect to FIG. 1. For discussion purposes, the condensate trap 600 will be described with respect to an indoor unit (e.g., unit 102) comprising a condensing furnace (e.g., furnace 150), which may include an air moving device such as a blower (e.g., fan 110) or inducer 650.

The condensate trap 600 includes an intake pipe 602 having an inlet 604, which may include a vent 606 configured to receive exhaust such as air, water, and the like. In a conventional HVAC system, the intake pipe 602 may include or be coupled to a pipe 608 through which exhaust may be drawn toward the inducer 650. While such systems may employ a drain pan (e.g., pan 250, 350, or 450) to collect condensation from a heat exchanger (e.g., exchanger 108, 204, or 304), the drain pan may not be situated or designed to prevent condensation from protruding onto equipment such as the inducer 650.

For example, the furnace in which the inducer 650 is implemented may operate at relatively low pressure such that ambient air flowing through the vent 606 condenses during cooling mode. In an embodiment, the condensate trap 600 may be disposed outside the furnace so as to bypass condensation from entering the inducer 650 of the furnace. To this end, the condensate trap 600 may include a primary channel 610 coupled to the pipe 608, and a filter 612 disposed at or near an entryway through which air flows from the intake pipe 602 and into the pipe 608. While the primary channel 610 is depicted as comprising a U-shaped section, the primary channel 610 may comprise any suitable shape.

The condensate trap 600 may further include a drain outlet 614 (e.g., similar to 408) to discharge condensation accumulated within the primary channel 610. The drain outlet 614 may generally be configured to discharge condensation at a rate such that condensation does not overfill the primary channel 610 and flow into the pipe 608 via an outlet 616 coupled to pipe 608. In some implementations, the outlet 616 may include a filter (not shown) similar to filter 612.

In operation, condensation formed from ambient air may flow downward with the aid of gravity and proceed to the primary channel 610, while filtered air may proceed to the pipe 608 via the filter 612. Accordingly, the condensate trap 600 may prevent or mitigate the flow of condensation through the pipe 608, thereby preventing or mitigating the possibility equipment such as the inducer 650 from water exposure and damage therefrom.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A condensate trap for an air handling unit, the condensate trap comprising:

at least one channel configured to selectively receive condensation flowing from the air handling unit;

a drain outlet configured to selectively discharge condensation from the at least one channel;

a sealing device configured to float above condensation flowing from the least one channel to the drain outlet, the sealing device further configured to sit atop a bottom surface of the at least one channel such that a seal is created between the sealing device and the at least one channel when the at least one channel does not contain condensation; and an opening disposed in the at least one channel that permits air to bypass the seal.

2. The condensate trap of claim 1, wherein the at least one channel is coupled to a drain pan configured to collect condensation formed during operation of the air handler.

3. The condensate trap of claim 1, wherein the sealing device is configured to float above condensation such that condensation flows from the at least one channel to the drain outlet without passing through the sealing device.

4. The condensate trap of claim 1, wherein the sealing device comprises a check ball.

5. The condensate trap of claim 1, wherein the sealing device comprises a flapper valve.

6. The condensate trap of claim 1, wherein the at least one channel comprises:

a first channel through which condensation from the air handling unit enters the condensate trap;

a second channel through which condensation exits the condensate trap via the drain outlet; and a lower channel through which condensation flows from the first channel to the second channel.

7. The condensate trap of claim 6, wherein the at least one channel further comprises a central channel through which the sealing device floats as condensation levels rise.

8. The condensate trap of claim 7, further comprising at least one vent configured to facilitate rising condensation levels such that the sealing device floats upward through the central channel.

9. The condensate trap of claim 7, wherein the central channel is parallel to the first and second channels, and wherein the lower channel is perpendicular to the central channel.

10. The condensate trap of claim 9, wherein the lower channel is perpendicular to the central channel.

11. The condensate trap of claim 7, wherein the at least one channel further comprises a fourth channel coupling the central channel to the second channel.

12. The condensate trap of claim 11, wherein the fourth channel includes a vent to facilitate the flow of condensation from the central channel to the drain outlet.

13. The condensate trap of claim 1, wherein the opening is formed between the sealing device and the at least one channel.

14. The condensate trap of claim 1, wherein the at least one channel comprises a protrusion configured to contact the sealing device when the at least one channel does not contain condensation, and wherein contact between the sealing device and the protrusion forms the opening in the at least one channel.

* * * * *